US012534886B2

(12) United States Patent
Kozui et al.

(10) Patent No.: US 12,534,886 B2
(45) Date of Patent: Jan. 27, 2026

(54) CONTROL DEVICE FOR CONSTRUCTION MACHINE AND CONSTRUCTION MACHINE EQUIPPED WITH SAME

(71) Applicants: HIROSHIMA UNIVERSITY, Higashi-Hiroshima (JP); KOBELCO CONSTRUCTION MACHINERY CO., LTD., Hiroshima (JP)

(72) Inventors: Masatoshi Kozui, Hiroshima (JP); Toru Yamamoto, Hiroshima (JP); Hideo Yoshihara, Hiroshima (JP); Kazushige Koiwai, Hiroshima (JP)

(73) Assignees: HIROSHIMA UNIVERSITY, Higashi (JP); KOBELCO CONSTRUCTION MACHINERY CO. , LTD., Hiroshima (JP)

( * ) Notice: Subject to any disclaimer, the term of this patent is extended or adjusted under 35 U.S.C. 154(b) by 24 days.

(21) Appl. No.: 18/728,924

(22) PCT Filed: Dec. 28, 2022

(86) PCT No.: PCT/JP2022/048585
§ 371 (c)(1),
(2) Date: Jul. 15, 2024

(87) PCT Pub. No.: WO2023/140092
PCT Pub. Date: Jul. 27, 2023

(65) Prior Publication Data

US 2025/0101715 A1 Mar. 27, 2025

(30) Foreign Application Priority Data

Jan. 21, 2022 (JP) ..... 2022-007850

(51) Int. Cl.
*E02F 9/26* (2006.01)
*E02F 9/20* (2006.01)
*E02F 3/43* (2006.01)

(52) U.S. Cl.
CPC ..... *E02F 9/265* (2013.01); *E02F 9/2041* (2013.01); *E02F 9/262* (2013.01); *E02F 3/439* (2013.01)

(58) Field of Classification Search
CPC ..... E02F 9/26; E02F 9/261; E02F 9/262; E02F 9/264; E02F 9/265; E02F 9/267;
(Continued)

(56) References Cited

U.S. PATENT DOCUMENTS 5,826,666 A 10/1998 Tozawa et al.
5,975,214 A 11/1999 Okamura et al.
(Continued)

FOREIGN PATENT DOCUMENTS

JP 9-228404 A 9/1997
JP 10-219727 A 8/1998
(Continued)

OTHER PUBLICATIONS

International Search Report issued Feb. 7, 2023 in PCT/JP2022/048585, filed Dec. 28, 2022, 3 pages.
Extended European Search Report issued Mar. 10, 2025 in European Patent Application No. 22922242.7, 6 pages.

*Primary Examiner* — Ramya P Burgess
*Assistant Examiner* — Sara J Lewandroski
(74) *Attorney, Agent, or Firm* — Oblon, McClelland, Maier & Neustadt, L.L.P.

(57) ABSTRACT

A controller includes a drive part, a posture information acquisition part, and a control part, the control part calculates a gravity center velocity of a working device on the basis of posture information about the working device detected by the posture information acquisition part and
(Continued)

calculates a target gravity center velocity being a target value of the gravity center velocity on the basis of a difference between a grounding work to be exerted to the ground by the working device and a target grounding work, and provides a feedback correction to an instruction signal to make the gravity center velocity approach the target gravity center velocity and inputs the corrected instruction signal into the drive part.

8 Claims, 6 Drawing Sheets

(58) Field of Classification Search
CPC ..... E02F 9/268; E02F 9/2025; E02F 9/2029; E02F 9/2033; E02F 9/2037; E02F 9/2041; E02F 9/2045; E02F 9/2203; E02F 9/2221; E02F 9/2253; E02F 3/43; E02F 3/431; E02F 3/432; E02F 3/433; E02F 3/434; E02F 3/435; E02F 3/436; E02F 3/437; E02F 3/438; E02F 3/439; E02F 3/16; E02F 3/26; E02F 3/651; E02F 3/84; E02F 3/907; E02F 3/841; E02F 5/145
See application file for complete search history.

(56) References Cited

U.S. PATENT DOCUMENTS

| | | | | |
|---|---|---|---|---|
| 2010/0204891 | A1* | 8/2010 | Biggerstaff | E02F 9/2033 701/50 |
| 2016/0369480 | A1* | 12/2016 | Mizuochi | F15B 13/06 |
| 2019/0078290 | A1 | 3/2019 | Yamada et al. | |
| 2019/0390436 | A1* | 12/2019 | Tanaka | E02F 3/437 |
| 2020/0224384 | A1* | 7/2020 | Suzuki | E02F 3/435 |
| 2021/0040705 | A1* | 2/2021 | Ishihara | E02F 9/265 |
| 2021/0301492 | A1 | 9/2021 | Nogi et al. | |
| 2021/0332561 | A1 | 10/2021 | Kozui et al. | |
| 2021/0340736 | A1 | 11/2021 | Kozui et al. | |
| 2022/0126816 | A1* | 4/2022 | Von Holst | E02F 9/2058 |

FOREIGN PATENT DOCUMENTS

| | | | | |
|---|---|---|---|---|
| JP | 2019-60109 | A | 4/2019 | |
| JP | 2020-29716 | A | 2/2020 | |
| JP | 2020-33814 | A | 3/2020 | |
| JP | 2020-33815 | A | 3/2020 | |
| WO | WO 2019/012701 | A1 | 1/2019 | |
| WO | WO-2020039834 | A1 * | 2/2020 | E02F 9/2296 |
| WO | WO-2020045579 | A1 * | 3/2020 | E02F 9/2203 |
| WO | WO-2021/241301 | A1 | 12/2021 | |

* cited by examiner

CONTROL DEVICE FOR CONSTRUCTION MACHINE AND CONSTRUCTION MACHINE EQUIPPED WITH SAME

TECHNICAL FIELD

The present invention relates to a controller for a construction machine, and a construction machine including the controller.

BACKGROUND ART

A hydraulic excavator including a machine body and a working attachment tiltably supported on the machine body has been conventionally known as a construction machine. The working attachment of the hydraulic excavator includes a boom tiltably supported on the machine body, an arm rotatably supported by the boom, and a bucket rotatably supported by the arm. The boom, the arm, and the bucket are respectively moved by associated hydraulic cylinders which are extendable and contractible. The hydraulic excavator may make flat ground preparation to the ground by using a leading end of the bucket. The flat ground preparation includes a leveling work, a bottom smoothing work, and a slope forming work, and other work. An unskilled operator finds it uneasy to adjust a pressing force or a compaction force to the ground by manipulating the working attachment to tilt, or be lowered or raised, in the flat ground preparation.

Patent Literature 1 discloses a technology of detecting a posture and a load of a working attachment, obtaining a pressing force of a bucket to the ground from the detected information, and automatically controlling extension and contraction of a boom cylinder to make the pressing force agree with a target value.

CITATION LIST

Patent Literature

Patent Literature 1: Japanese Unexamined Patent Publication No HEI 10-219727

The technology described in Patent Literature 1 depends on estimation of the pressing force from a pressure of the hydraulic cylinder, and thus has a drawback of a difficulty in controlling the pressing force to be steady by extending and contracting the hydraulic cylinder from the perspectives of a pressure fluctuation attributed to an even ground surface and a pressing force fluctuation influenced by a counterforce and other factor attributed to a soil quality.

SUMMARY OF INVENTION

An object of the present invention is to provide a controller for a construction machine that enables flat ground preparation while keeping a steady pressing force to the ground, and a construction machine including the controller.

The present invention provides a controller for a construction machine. The construction machine includes a machine body and a working device tiltably supported on the machine body and having a plurality of members which are movable relative to each other. The controller includes a manipulation instruction receiving part, a drive part, a posture information acquisition part, and a control part. The drive part drives the working device at a velocity in accordance with an instruction signal for driving the working device. The posture information acquisition part acquires posture information about a posture of the working device relative to the machine body. The control part inputs the instruction signal into the drive part. The control part calculates a gravity center velocity being a velocity at a composite gravity center of the plurality of members on the basis of the posture information and calculates a target gravity center velocity being a target value of the gravity center velocity on the basis of a difference between a grounding work to be exerted to the ground by the working device and a target grounding work being a target value of the grounding work, and provides a feedback correction to the instruction signal to make the gravity center velocity approach the target gravity center velocity and inputs the corrected instruction signal into the drive part.

The present invention provides a construction machine including: a machine body; a working device tiltably supported on the machine body; and the controller described above for the construction machine.

DESCRIPTION OF EMBODIMENTS

Hereinafter, preferable embodiments of the present invention will be described with reference to the accompanying drawings.

Figure 1:
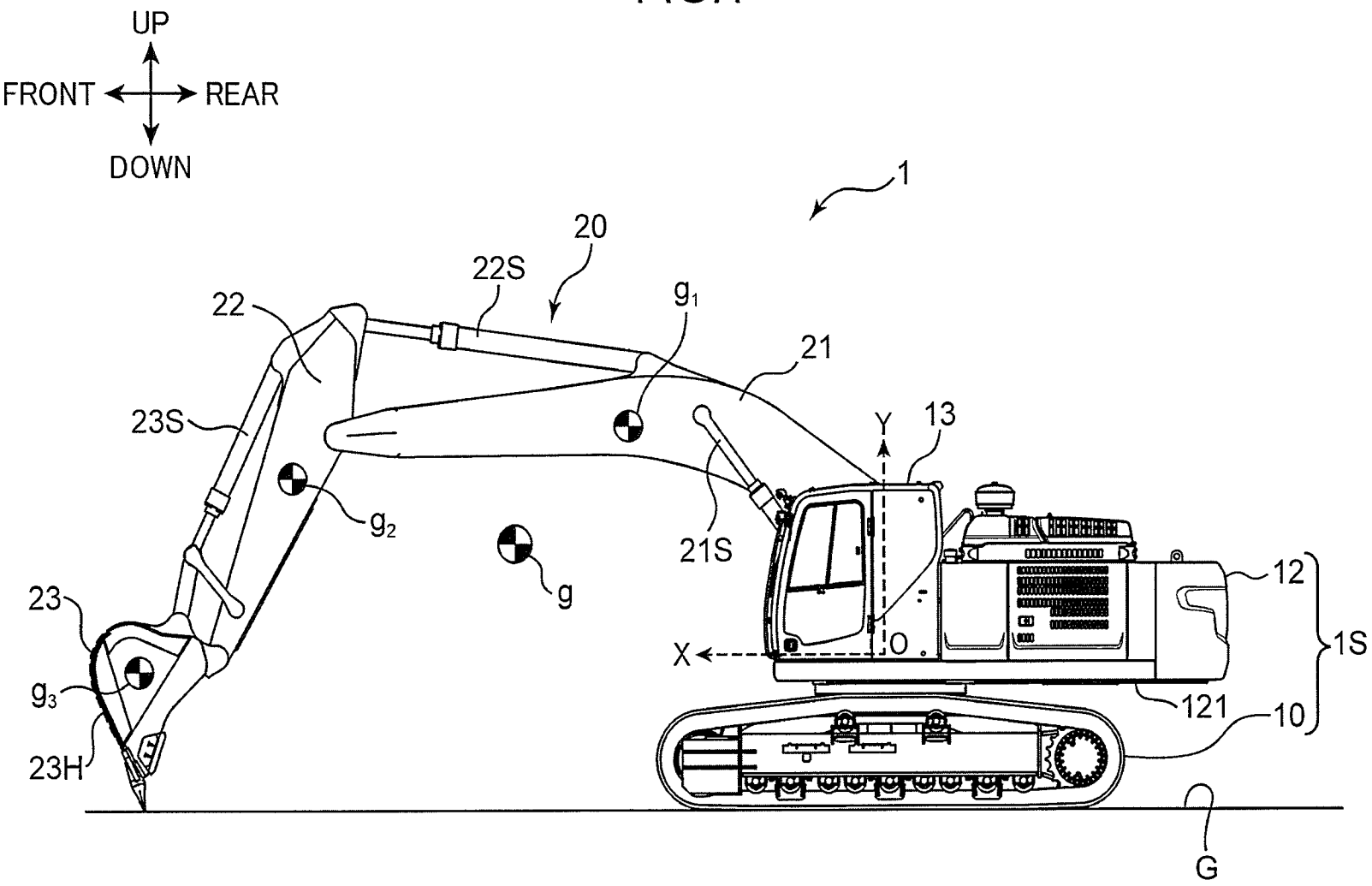
FIG. 1 is a side view of a construction machine including a controller according to an embodiment of the present invention.

FIG. 1 is a side view of a hydraulic excavator 1 or a construction machine provided with a controller 1A (FIG. 2) according to an embodiment of the present invention. The hydraulic excavator 1 includes a lower traveling body 10 of a crawler type that can travel on a traveling surface or on the ground G, an upper slewing body 12 mounted on the lower traveling body 10 slewably about a slewing central axis which is perpendicular to the traveling surface, and a working attachment 20 or a working device tiltably mounted on the upper slewing body 12. The working attachment 20 includes a boom 21 tiltably supported on the upper slewing body 12, an arm 22 rotatably connected to a distal end of the boom 21, and a bucket 23 or a leading end member rotatably connected to a distal end of the arm 22. The bucket 23 has a bucket bottom 23H. The upper slewing body 12 has a slewing frame 121 and a cab 13. The lower traveling body 10 and the upper slewing body 12 constitute a machine body 1S in the present invention. The boom 21, the arm 22, and the bucket 23 correspond to a plurality of members in the present invention which are movable relative to each other.

The hydraulic excavator 1 includes a boom cylinder 21S that operates to lower and raise the boom 21 with respect to the upper slewing body 12, an arm cylinder 22S that operates to rotate the arm 22 with respect to the boom 21, and a bucket cylinder 23S that operates to rotate the bucket 23 with respect to the arm 22. Each cylinder operates to extend and contract by receiving hydraulic fluid from a hydraulic pump.

Figure 2:
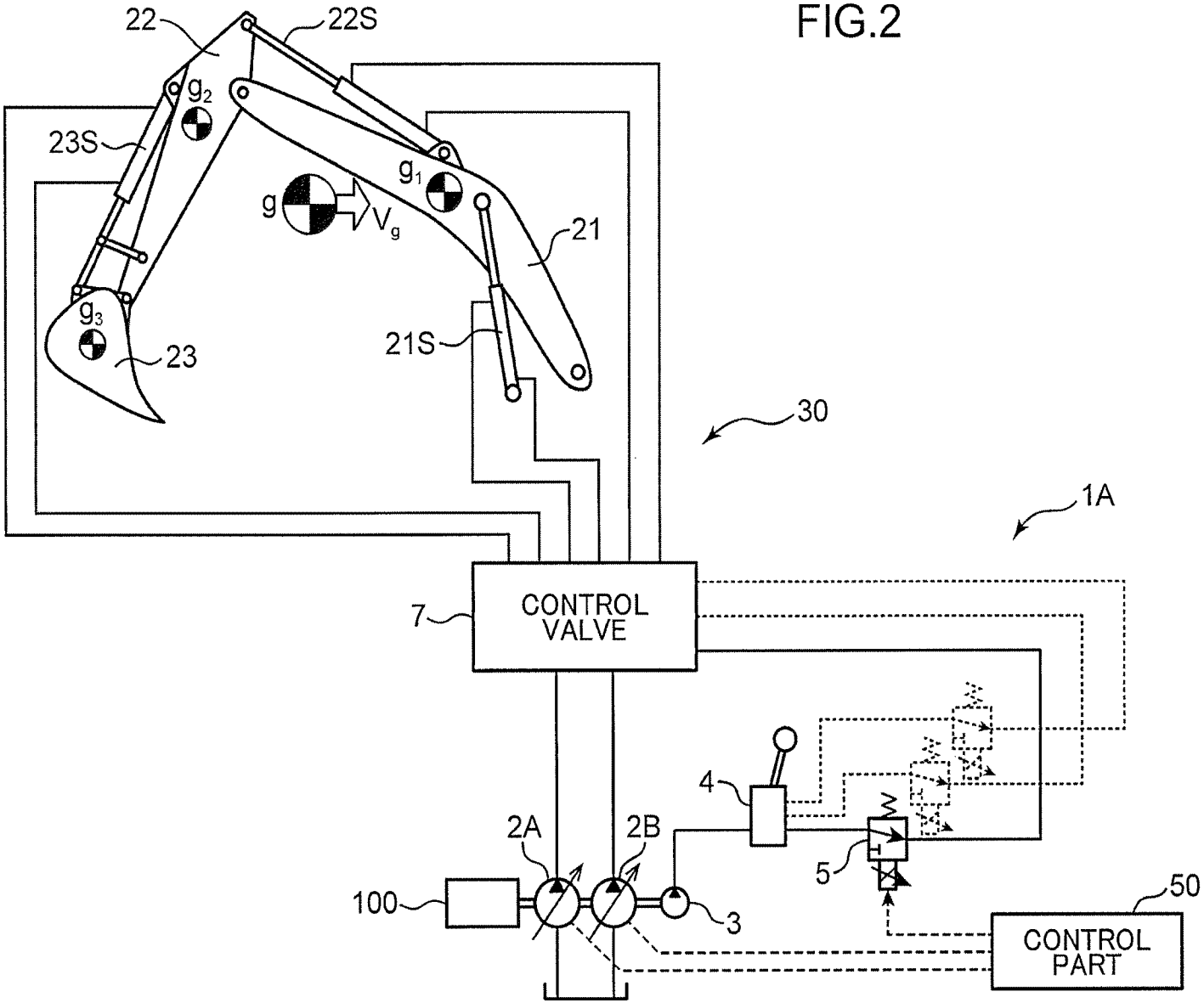
FIG. 2 is a hydraulic circuit diagram of the controller according to the embodiment of the present invention.

FIG. 2 is a hydraulic circuit diagram of the controller 1A according to the embodiment of the present invention. The same constituent elements in FIG. 2 as those of the hydraulic excavator 1 shown in FIG. 1 are given the same reference numerals and signs. In FIG. 2, the sign "$g_1$" denotes a gravity center of the boom 21, the sign "$g_2$" denotes a gravity center of the arm 22, the sign "$g_3$" denotes a gravity center of the bucket 23, and the sign "g" denotes a composite gravity center of the working attachment 20.

The hydraulic excavator 1 further includes an engine 100, a first pump 2A and a second pump 2B each being of a hydraulic type, a pilot pressure fluid-hydraulic pump 3, a manipulation part 4, a proportional solenoid valve 5, a control valve 7, and a control part 50.

The engine 100 is controlled by an electronic control unit (ECU) 32 to be described later and receives fuel with a predetermined injection amount to rotate. The first pump 2A and the second pump 2B are connected to an output shaft of the engine 100 to receive a drive force of the engine 100 and rotate. Each pump is a hydraulic pump and discharges hydraulic fluid to activate each of the boom cylinder 21S, the arm cylinder 22S, and the bucket cylinder 23S.

The boom cylinder 21S extends and contracts by receiving a supply of the hydraulic fluid from the first pump 2A to raise and lower, i.e., move, the boom 21. In the embodiment, the boom cylinder 21S includes: a cylinder main body; and a cylinder rod having a piston which divides the cylinder main body into a head chamber and a rod chamber and being shiftable relative to the cylinder main body. The cylinder rod has a distal end connected to the boom 21 via an unillustrated link mechanism. The boom cylinder 21S is extendable by receiving the hydraulic fluid discharged from the first pump 2A into the head chamber via the control valve 7 and discharging the hydraulic fluid from the rod chamber to perform a boom raising operation of raising the boom 21, and is contractible by receiving the hydraulic fluid discharged from the first pump 2A into the rod chamber via the control valve 7 and discharging the hydraulic fluid from the head chamber to perform a boom lowering operation of lowering the boom 21. Each of the arm cylinder 22S and the bucket cylinder 23S has a structure similar to the structure of the boom cylinder 21S.

The manipulation part 4 includes a lever to be manipulated by an operator, and receives manipulations for moving the boom 21, the arm 22, and the bucket 23 of the working attachment 20 respectively. Specifically, the manipulation part 4 includes a boom manipulation part, an arm manipulation part, and a bucket manipulation part. For each manipulation, a manipulation direction and a manipulation amount are defined to be variable. The manipulation part 4 further receives a manipulation for a slewing operation of the upper slewing body 12 and a manipulation for a traveling operation of the lower traveling body 10. The manipulation part 4 constitutes the manipulation instruction receiving part in the present invention. Each manipulation received by the manipulation part 4 corresponds to manipulation instruction information in the present invention.

The control valve 7 (a boom cylinder adjustment mechanism, an arm cylinder adjustment mechanism) is arranged among the hydraulic pumps and the boom cylinder 21S, and has a spool that shifts to change or regulate a flow rate and a flow path of the hydraulic fluid to be supplied from each hydraulic pump to the boom cylinder 21S. Specifically, the control valve 7 mainly operates to supply the hydraulic fluid from the hydraulic pump to the boom cylinder 21S and discharge the hydraulic fluid having flowed from the boom cylinder 21S to an unillustrated tank in the boom raising operation and the boom lowering operation of the boom 21. The control valve 7 is in the form of a pilot-operative three-position direction selector valve having a pair of pilot ports.

The control valve 7 is kept at a neutral position to disconnect the hydraulic pump and the boom cylinder 21S from each other when both the pair of pilot ports receive no pilot pressure.

The control valve 7 is shifted from the neutral position to a boom lowering position at a stroke corresponding to a boom lowering pilot pressure in response to the boom lowering pilot pressure input into one of the pilot ports. In this manner, the control valve 7 opens to permit the hydraulic fluid to flow from the hydraulic pump into the rod chamber of the boom cylinder 21S at a flow rate corresponding to the stroke and permit the hydraulic fluid to flow out of the head chamber of the boom cylinder 21S. The boom cylinder 21S is consequently driven in a boom lowering direction at a velocity under the boom lowering pilot pressure.

The control valve 7 is shifted from the neutral position to a boom raising position at a stroke corresponding to a boom raising pilot pressure in response to the boom raising pilot pressure input into the other of the pilot ports. In this manner, the control valve 7 opens to permit the hydraulic fluid to flow from the hydraulic pump into the head chamber of the boom cylinder 218 at a flow rate corresponding to the stroke and permit the hydraulic fluid to flow out of the rod chamber of the boom cylinder 21S. The boom cylinder 21S is consequently driven in a boom raising direction at a velocity under the boom raising pilot pressure.

A control valve 7 that executes an operation similar to the operation as described above is arranged among the hydraulic pumps and each of the arm cylinder 22S and the bucket cylinder 23S. The control valve 7 for the arm cylinder 22S is shiftable among an arm pushing position, a neutral position, and an arm pulling position.

The proportional solenoid valve 5 (the boom cylinder adjustment mechanism, the arm cylinder adjustment mechanism) opens to make a pilot pressure or a secondary pressure associated with a manipulation input into the manipulation part 4 act to each pilot port of the control valve 7 with pilot fluid supplied from the pilot pressure fluid-hydraulic pump 3. The proportional solenoid valve 5 has an opening degree which is adjusted in accordance with a proportional signal from the control part 50. In another embodiment, an unillustrated remote-control valve that opens depending on an angle of the lever of the manipulation part 4 may transfer a pressure serving as a secondary pressure to the control valve 7. In this case, a proportional valve may be provided between the lever and the control valve 7 so that the proportional valve adjusts the secondary pressure before the secondary pressure reaches the control valve 7.

As shown in FIG. 2, each of the boom cylinder 21S, the arm cylinder 22S, and the bucket cylinder 23S extends or contracts by receiving a supply of the hydraulic fluid from each of the pumps 2A, 2B in accordance with a manipulation amount that is an amount of a manipulation received by the manipulation part 4. Each of the boom cylinder 21S, the arm cylinder 22S, and the bucket cylinder 23S receives a supply of the hydraulic fluid from each of the pumps 2A and 2B through the control valve 7 which changes a direction of the supplied fluid. In FIG. 2, the drive part 30 is defined to collectively include the hydraulic circuit and the engine 100 for driving the working attachment 20. The control part 50 inputs an instruction signal into the drive part 30 in accordance with the manipulation amount. The control part 50 controls driving of the working attachment 20 by controlling the hydraulic system shown in FIG. 2. The drive part 30 is operative to drive each member of the working attachment 20 at a velocity in accordance with the instruction signal or a proportional signal input into the proportional solenoid valve 5 for driving the working attachment 20.

The embodiment has features in that the control part 50 measures or calculates a velocity at a composite gravity center of the plurality of members (the boom 21, the arm 22, and the bucket 23 in the embodiment) constituting the working attachment 20, determines an instruction value for a manipulation mechanism of the working attachment 20, which is a mechanism that adjusts a manipulation amount by the operator with respect to the working attachment 20 and corresponds to the proportional solenoid valve 5 in the embodiment, under a feedback control to make the velocity follow a predetermined target value, and adjusts the manipulation amount by the operator with respect to the drive part 30.

Figure 3:
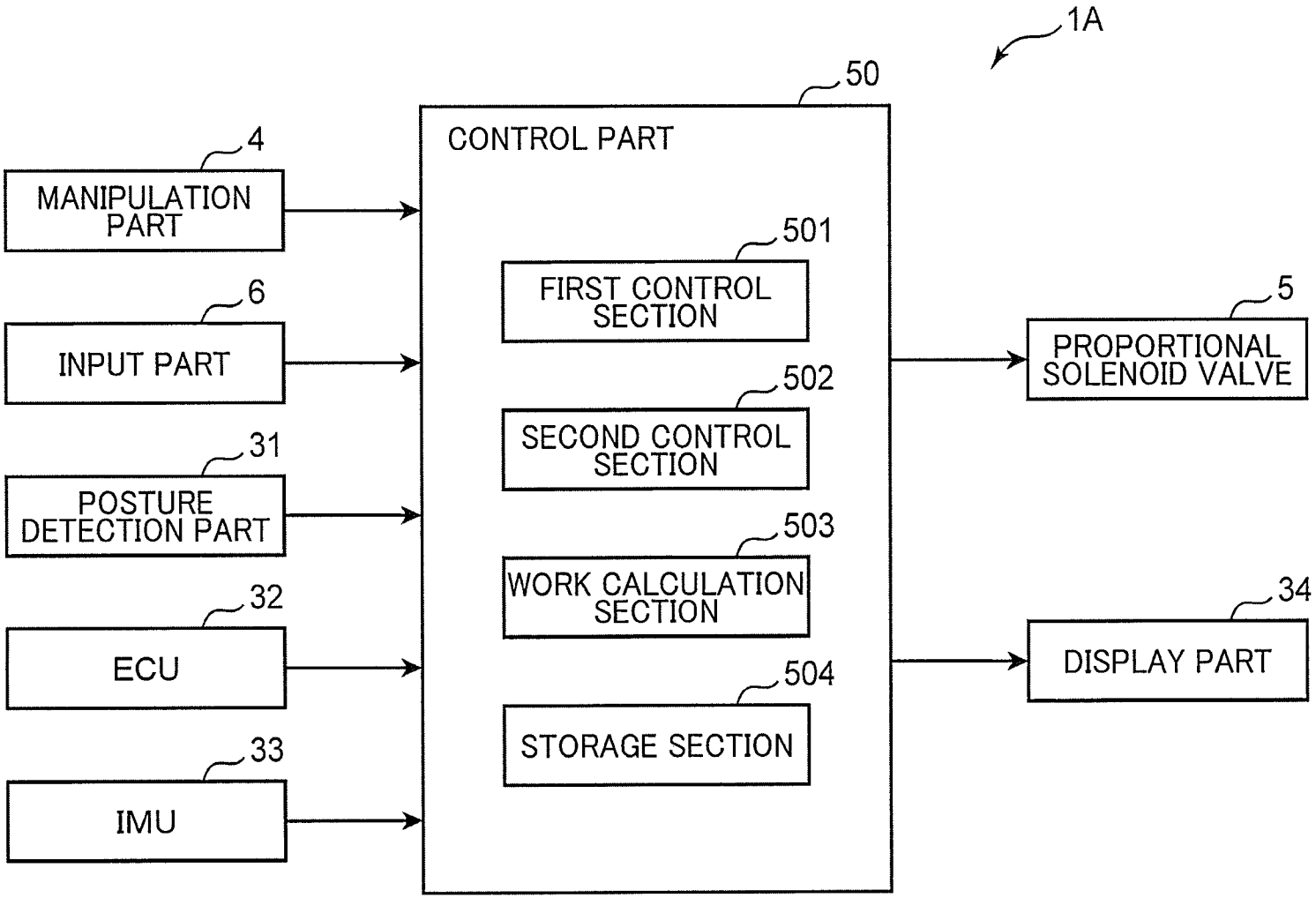
FIG. 3 is a block diagram of the controller according to the embodiment of the present invention.

FIG. 3 is a block diagram of the controller 1A according to the embodiment. In the embodiment, the control part 50 may be located in, for example, an operating compartment on the upper slewing body 12. The control part 50 includes a computer, and each function comes into effect when the computer executes a program. The computer includes a processor mainly constituting hardware to operate in accordance with the program. The processor may be of any type to enable the function through the execution of the program, and thus may include one or more electronic circuits including, for example, a semiconductor integrated circuit (IC) or a large scale integration (LSI). The electronic circuits may be collected on a single chip or may be provided on a plurality of chips. The chips may be integrally collected in a single device or included in a plurality of devices. The program is stored in a non-transitory computer readable storage medium, such as a read only memory (ROM), an optical disk, and a hard disk drive. The program may be stored in the storage medium in advance or may be supplied to the storage medium via a broadband network including the internet.

In this regard, the control part 50 includes, for example, a central processing unit (CPU), a read only memory (ROM) which stores a control program, and a random access memory (RAM) for use as a working area of the CPU. The control part 50 functions to include a first control section 501, a second control section 502, a work calculation section 503, and a storage section 504 when the CPU executes the control program stored in the ROM. The functional sections have no entities, and respectively correspond to units of functions to be executed by the control program. Here, an entirety of or a part of the control part 50 may not be limitedly provided in the hydraulic excavator 1, and may be provided at a different position other than the position in the hydraulic excavator 1 for a remote control of the hydraulic excavator 1. Further, the control program may be transmitted from a server or a management device at a remote location or a cloud to the control part 50 in the hydraulic excavator 1 to be executed, or the control program may be executed on the server or the cloud and any kind of generated instruction signal may be transmitted to the hydraulic excavator 1.

The first control section 501 adjusts a boom input into the proportional solenoid valve 5, under the control executed by the control part 50, to make a gravity center velocity of the working attachment 20 follow or approach a target gravity center velocity. The second control section 502 regulates a target gravity center velocity of the working attachment 20, under the control executed by the control part 50, to make a compaction work, which is referred to as a grounding work, to be exerted to the ground G by the working attachment 20 follow or approach a target compaction work which is referred to as a target grounding work. The target compaction work is a target value of the compaction work. The work calculation section 503 serves as a power converter and calculates, on the basis of the composite gravity center velocity of the working attachment 20, a compaction work to be exerted to the ground G by the working attachment 20. The storage section 504 stores a parameter and a threshold required in each process executed by the control part 50.

The hydraulic excavator 1 further includes: an input part 6; a posture detection part 31 or a posture information acquisition part; the engine control unit (ECU) 32 or a work information acquisition part; an inertial measurement unit (IM (J) 33; and a display part 34. The input part 6 is located in the cab 13 and receives an input of information which is necessary for the control part 50 to execute the control. The input part 6 receives, for example, an input of a target compaction work to be described later.

The posture detection part 31 detects information about a posture of the working attachment 20. Specifically, the posture detection part 31 acquires posture information about the posture of the working attachment 20 relative to the upper slewing body 12. For instance, the posture detection part 31 includes three sensors respectively to be attached to the boom cylinder 21S, the arm cylinder 22S, and the bucket cylinder 23S to each detect a stroke (including an extension amount and a length) of the associated cylinder. The stroke of each cylinder detected by each sensor is used to calculate a position and a posture of each of the boom 21, the arm 22, and the bucket 23, and is further used to calculate a position of the composite gravity center of the working attachment 20 and the velocity of the composite gravity center of the working attachment 20. An angle sensor that detects a rotation angle of each of the boom 21, the arm 22, and the bucket 23 may be adopted in place of the corresponding cylinder stroke sensor to calculate the position and the posture of each of the boom 21, the arm 22, and the bucket 23.

The ECU 32 receives a rotational speed instruction signal from the control part 50 and controls the engine 100 to rotate the engine 100 at a fuel injection amount in accordance with the received rotational speed instruction signal. The ECU 32 further serves as the work information acquisition part that acquires information about a work which is exerted by the drive part. In particular, the ECU 32 acquires information about a machine body motive power P(t).

The IMU 33 detects information about a posture of the upper slewing body 12 to the ground G. In other words, the IMU 33 detects a posture and an angle, i.e., a tilt, of the machine body of the hydraulic excavator 1. For instance, the IMU 33 is attached to an upper surface portion of the cab 13.

The display part 34 includes a liquid crystal display arranged in the cab 13, and displays various kinds of information about operations of the hydraulic excavator 1 and about the control by the controller 1A to notify the operator of the information.

Figure 4:
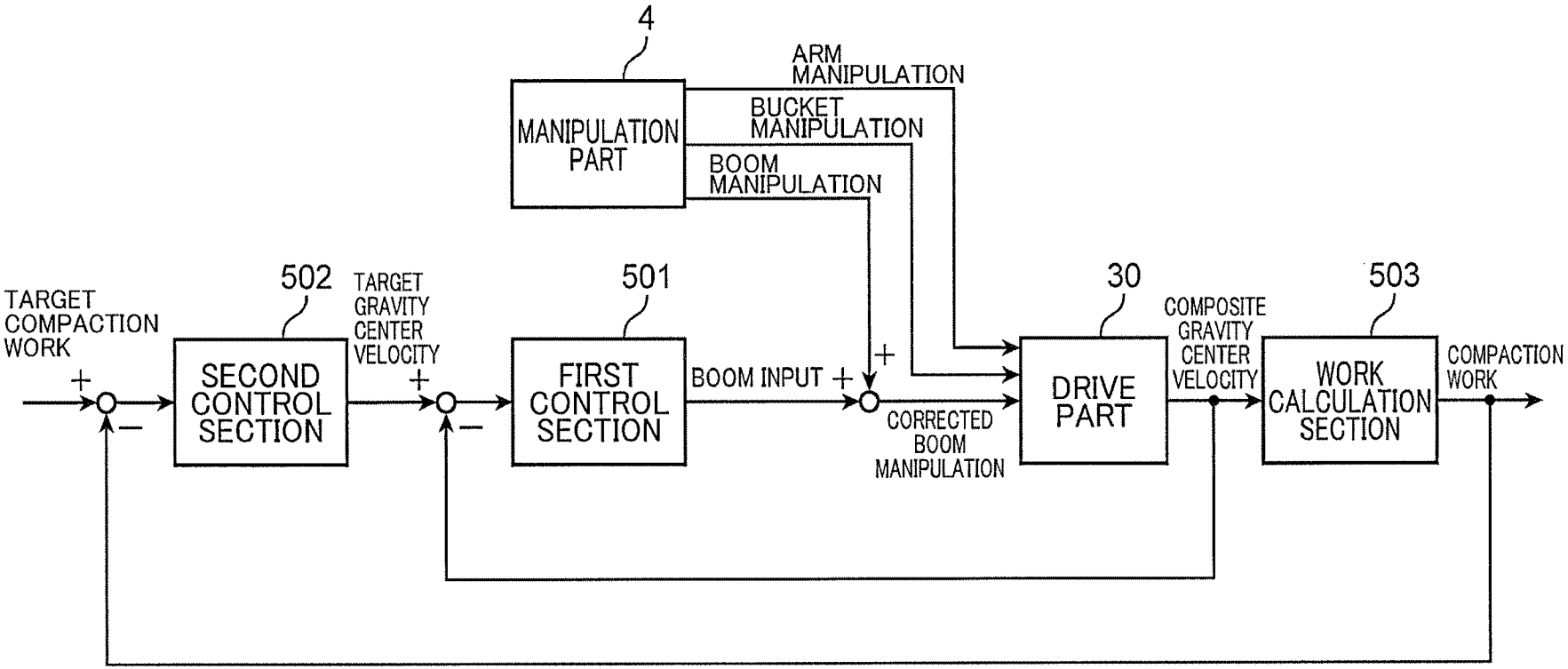
FIG. 4 is a control procedure diagram of the controller according to the embodiment of the present invention.
Figure 5:
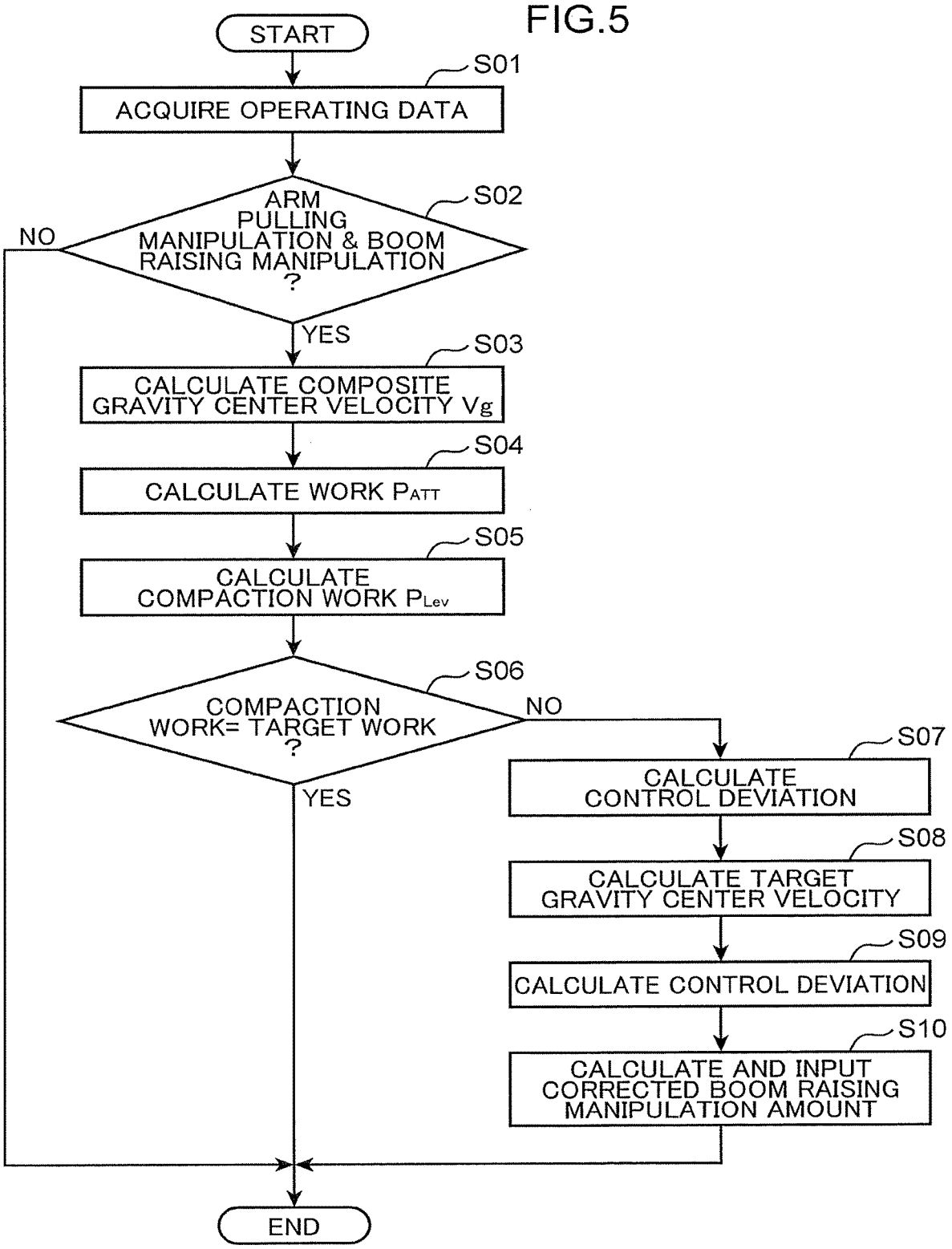
FIG. 5 is a flowchart of a control executed by the controller according to the embodiment of the present invention.

FIG. 4 is a control procedure diagram of the controller 1A according to the embodiment. FIG. 5 is a flowchart of the control executed by the controller 1A. The inventors of the present invention have newly obtained the knowledge through an experiment that the velocity at the composite gravity center of the working attachment 20 is substantially constant in a stable operation with a good accuracy in flat ground preparation by the hydraulic excavator 1. The embodiment achieves stable flat ground preparation while keeping a steady compaction force or pressing force of the bucket 23 to the ground G by making the control part 50 control the velocity at the composite gravity center to follow a target gravity center velocity.

The embodiment describes an example of flat ground preparation including preparing the ground to be flat by the bucket bottom 23H of the bucket 23 while moving each of the boom 21, the arm 22, and the bucket 23 of the working attachment 20 in response to a manipulation to the manipulation part 4 by the operator. In FIG. 1, the operator performs the manipulation to move the bucket bottom 23H rearward, that is, toward the upper slewing body 12, by pressing the bucket bottom 23H against the ground and raising the boom 21 while pulling the arm 22 toward the operator. When the arm 22 finally comes to a posture extending in a vertical direction, the operator continues the flat ground preparation by lowering the boom 21 and pulling the arm 22. In this case, as shown in FIG. 4, the arm cylinder 22S and the bucket cylinder 23S are driven respectively for the arm 22 and the bucket 23 in accordance with proportional signals input into the proportional solenoid valve 5 and reflecting respective manipulation amounts of an arm manipulation and a bucket manipulation input into the manipulation part 4. By contrast, a manipulation amount of a boom manipulation input into the manipulation part 4 is subjected to a predetermined correction and a proportional signal reflecting the corrected manipulation amount is input into the proportional solenoid valve 5 for the movement of the boom 21 greatly contributing to the compaction force of the bucket bottom 23H to the ground G.

As shown in FIG. 1 and FIG. 2, a rotation proximal end of the boom 21 of the working attachment 20 is defined as an origin "0", a Y-coordinate is defined in a vertical direction from the origin, an X-coordinate is defined in a horizontal direction from the origin, a mass of the boom 21 is defined as "$m_1$", a coordinate of the gravity center $g_1$ of the boom 21 is defined as "$(x_1(t), y_1(t))$", a mass of the arm 22 is defined as "$m_2$", a coordinate of the gravity center $g_2$ of the arm 22 is defined as "$(x_2(t), y_2(t))$", a mass of the bucket 23 is defined as "$m_3$", and a coordinate of the gravity center $g_3$ of the bucket 23 is defined as "$(x_3(t), y_3(t))$". It is noted here that each coordinate changes in a progress of an operation of the working attachment 20, and thus, is expressed as a variable depending on a time t. In this case, the coordinate $(x_g(t), y_g(t))$ of the composite gravity center g of the working attachment 20 is expressible by the following Equation 1.

Formula 1

$$(X_g(t), Y_g(t)) = \left(\frac{\sum_{i=1}^{3} m_i x_i(t)}{m_1 + m_2 + m_3}, \frac{\sum_{i=1}^{3} m_i y_i(t)}{m_1 + m_2 + m_3}\right) \quad \text{Equation 1}$$

Besides, use of Equation 1 allows the velocity $V_g(t)$ at the composite gravity center g to be expressed by the following Equation 2.

Formula 2

$$V_g(t) = \sqrt{\frac{dX_g(t)^2}{dt} + \frac{dY_g(t)^2}{dt}} \quad \text{Equation 2}$$

As shown in FIG. 4, the composite gravity center velocity $V_g(t)$ is fed back, and the first control section 501 adjusts an input u(t) of a boom manipulation in the flat ground preparation to make the composite gravity center velocity $V_g(t)$ follow a target gravity center velocity r(t). The input u(t) corresponds to the proportional signal input into the proportional solenoid valve 5. Here, a Proportional Integral Differential (PID) control rule in each of Equation 3, Equation 4, and Equation 5 is adaptable to an adjustment rule for the input u(t). The sign "$u_h(t)$" denotes a boom manipulation amount by the operator, and the sign "$u_c(t)$" denotes a boom manipulation amount set by the first control section 501 of the control part 50.

Formula 3

$$u(t) = u_h(t) + u_c(t) \quad \text{Equation 3}$$

Formula 4

$$u_c(t) = u_c(t-1) + K_{p1}(t)\Delta e(t) + K_{i1}e(t) + K_{d1}(t)\Delta^2 e(t) \quad \text{Equation 4}$$

Formula 5

$$e(t) := r(t) - V_g(t) \quad \text{Equation 5}$$

The PID control rule in Equation 4 shows "$K_{p1}$" denoting a proportional gain, "$K_{i1}$" denoting an integral gain, and "$K_{d1}$" denoting a derivative gain. The input $u_c(t)$, i.e., the boom manipulation amount, is adjusted in accordance with a control deviation e(t).

Further, as shown in FIG. 4, the control executed by the control part 50 establishes a cascade control system including an inner closed loop for compensation of the composite gravity center velocity to be executed by the first control section 501 and an outer closed loop for compensation of a compaction work. Concerning the outer loop in FIG. 4, first, the work calculation section 503 calculates a kinetic energy of the working attachment 20 from Equation 6 by using the composite gravity center velocity $V_g(t)$ in accordance with the movement of the work attachment 20. The sign "M" in Equation 6 denotes a mass of an entirety of the working attachment 20 and takes a known value.

Formula 6

$$E_{ATT}(t) = \frac{1}{2} M V_g(t)^2 \quad \text{Equation 6}$$

Subsequently, the work calculation section 503 calculates, from the kinetic energy $E_{ATT}(t)$ calculated by using Equation 6, a work or a drive work for driving the working attachment 20 by using Equation 7. The sign "$T_s$" denotes a sampling time for the control executed by the control part 50.

Formula 7

$$P_{ATT}(t) = E_{ATT}(t) \times T_s \quad \text{Equation 7}$$

In a case where the original machine body motive power P(t) to be adopted for working of the working attachment 20 is known, the work calculation section 503 can obtain, by using Equation 8, a work or a compaction work $P_{Leveling}(t)$ only for compaction to the ground G by the bucket bottom 23H of the bucket 23.

Formula 8

$$P_{Leveling}(t) = P(t) - P_{ATT}(t) \quad \text{Equation 8}$$

The sign "P(t)" denotes, for example, a work or an output to be exerted by the engine 100 in accordance with input energy or fuel injection, and is acquirable from the ECU 32 in FIG. 3. The work can be called an input work as well.

Equation 8 defines the output from the engine 100 as convertible at 100% into an operation of the working attachment 20 and a work to the ground G, regardless of a mechanical loss. By contrast, in a case where an efficiency of the hydraulic excavator 1 is known from the specification thereof, a compaction work only for compaction to the ground G may be calculated in view of a loss coefficient η as shown in Equation 9.

Formula 9

$$P_{Leveling}(t) = \eta(P(t) - P_{ATT}(t)) \quad \text{Equation 9}$$

Alternatively, a predetermined loss constant may be added to the right side of Equation 8 instead of using Equation 9.

Then, the compaction work $P_{Leveling}(t)$ in Equation 8 or Equation 9 is fed back, and the second control section 502 regulates the target gravity center velocity r(t) in the flat ground preparation to satisfy the target compaction work $P_r(t)$. For instance, a PID control rule in Equation 10 or Equation 11 is adaptable to a regulation rule in this case.

Formula 10

$$r(t) = r(t-1) + K_{p2}(t)\Delta e'(t) + K_{i2}e'(t) + K_{d2}\Delta^2 e'(t) \quad \text{Equation 10}$$

Formula 11

$$e'(t) := P_r(t) - P_{Leveling}(t) \quad \text{Equation 11}$$

Here, the PID control rule in Equation 10 shows "$K_{p2}$" denoting a proportional gain, "$K_{i2}$" denoting an integral gain, and "$K_{d2}$" denoting a derivative gain. The target gravity center velocity r(t) is regulated in accordance with a control deviation e'(t).

The target compaction work $P_r(t)$ may be appropriately set, or may be determined on the basis of a strength index, e.g., strong, intermediate, and weak, set in advance and further in accordance with a working condition, such as a smoothed ground angle and a velocity of an attachment, that is, mainly a velocity of the arm, with reference to a lookup table (LUT) stored in the storage section 504. A known database drive-type approach may be used to compare a current working condition with a condition stored in a database on the basis of a known norm-L1, and newly calculate a target compaction work with reference to the latest condition from a plurality of databases by a weighted local linear averaging way.

Next, an execution sequence of the control in the hydraulic excavator 1 will be described in detail. As shown in FIG. 5, when the control is started in the hydraulic excavator 1, the control part 50 acquires operating data which is necessary to execute the control (step S01). For instance, the posture detection part 31 acquires posture information about the working attachment 20. The control part 50 receives a machine body motive power P(t) of the engine 100 input from the ECU 32.

Subsequently, the control part 50 determines, from a manipulation direction and a manipulation amount input into the manipulation part 4, whether each of the arm pulling manipulation and the boom raising manipulation is input for the boom 21, the arm 22, and the bucket 23 (step S02). When the manipulation part 4 receives an input of each of the arm pulling manipulation and the boom raising manipulation (YES in step S02), the first control section 501 calculates a composite gravity center velocity $V_g$ (step S03). When the manipulation part 4 does not receive an input of either the arm pulling manipulation and an input of the boom raising manipulation (NO in step S02), the control part 50 finishes the process in FIG. 5.

When the composite gravity center velocity $V_g(t)$ is calculated in step S03, the work calculation section 503 calculates a work $P_{ATT}(t)$ by using Equation 7 mentioned above (step S04). Further, the work calculation section 503 calculates a compaction work $P_{Lev}(t)$ (step S05).

Then, the second control section 502 determines whether the calculated compaction work agrees with a preset target compaction work (step S06). In the determination, a predetermined difference range may be added. When the compaction work agrees with the target compaction work in step S06, the process in FIG. 5 finishes. By contrast, when the compaction work does not agree with the target compaction work (NO in step S06), the second control section 502 calculates a deviation or a difference between the compaction work $P_{Lev}(t)$ and a target compaction work $P_r(t)$ (step S07) by using Equation 11 mentioned above. The second control section 502 thereafter calculates a target gravity center velocity r(t) to make the compaction work $P_{Lev}(t)$ approach the target compaction work $P_r(t)$ (step S08). Further, the first control section 501 calculates a deviation between the target gravity center velocity r(t) and the gravity center velocity $V_g(t)$ from Equation 5 (step S09), and calculates a boom input u(t) from Equation 3 and Equation 4 by using the newly calculated target gravity center velocity r(t). The first control section 501 corrects the boom manipulation amount input into the manipulation part 4 and inputs a proportional signal reflecting the corrected value into the proportional solenoid valve 5 (step S10), and finishes the process in FIG. 5. The process in FIG. 5 is repeated in a predetermined control cycle during the operation of the hydraulic excavator 1.

Conclusively, in the embodiment, the control part 50 calculates a gravity center velocity being a velocity at a composite gravity center of a plurality of members of the working attachment 20 on the basis of posture information acquired by the posture detection part 31 and calculates a target gravity center velocity being a target value of the gravity center velocity on the basis of a difference between a compaction work to be exerted to the ground G by the working attachment 20 and a target compaction work, and provides a feedback correction to an instruction signal to make the gravity center velocity approach the target gravity center velocity and inputs the corrected instruction signal into the proportional solenoid valve 5 of the drive part. Ways of providing the feedback correction may include a way of correcting a manipulation amount received by the manipulation part 4 and generating an instruction signal reflecting the corrected manipulation amount, and a way of providing a correction to an instruction signal reflecting a manipulation amount received by the manipulation part 4.

This configuration causes the control part 50 to control a movement of the working attachment 20 by inputting an instruction signal into the proportional solenoid valve 5 to make the composite gravity center velocity of the working attachment 20 approach the target gravity center velocity in the flat ground preparation conducted by the working attachment 20 in response to a manipulation to the manipulation part 4 by the operator. At this time, the control part 50 calculates the target gravity center velocity on the basis of a difference between the compaction work to be exerted to the ground G by the working attachment 20 and the target compaction work. The target compaction work is a target value of the compaction work. This configuration achieves stable and accurate flat ground preparation with a steady compaction force of the working attachment 20 to the ground G. The configuration further attains a control of the compaction force more comprehensively with a smaller variation while avoiding an influence of a composite difference between the pressures of the cylinders than a conventional configuration of controlling a compaction force to the ground G while estimating the compaction force from a pressure of each cylinder to move the working attachment 20.

In particular, a stable arm manipulation by an operator to move the arm 22 leads to a facilitated adjustment of a boom manipulation being a load adjustment manipulation to the ground G without individually sensing and regulating a velocity of each cylinder or actuator. This results in achieving a smooth locus of an operation of the bucket 23 of the working attachment 20, that is, a stable accuracy of the smoothed surface, in the flat ground preparation with the steady compaction force to the ground G in the flat ground preparation.

The target gravity center velocity is regulated so that the compaction work is kept stable even in a change in an operation balance in the working attachment 20 due to a change in an operation of a member other than the boom 21, e.g., a change in the velocity of the arm 22. The regulation attains a steadily kept compaction force to the ground G. Moreover, the target velocity is regulated and the boom manipulation amount is adjusted to make the compaction work stable in a state of removing a load from the boom cylinder 21S in a boom raising operation, in a state of applying the load into the boom cylinder 21S in a boom lowering operation, and even before and after switching between these states, in the flat ground preparation. This facilitates and smooths the flat ground preparation at the time of raising the boom and at the time of lowering the boom.

As described heretofore, the embodiment is adaptable to a system that focuses on a composite gravity center velocity of a plurality of members (the boom 21, the arm 22, and the bucket 23) constituting the working attachment 20 and equivalently expresses a movement of the working attachment 20 solely with the composite gravity center. For instance, in a case where the composite gravity center velocity deviates from a target value due to an excessive manipulation by an operator, this configuration can reduce the manipulation amount by the operator to make the velocity follow the target value.

In the embodiment, the control part 50 calculates the compaction work to be exerted to the ground G by the working attachment 20 from a difference between a work or an input work of the drive part, particularly, of the engine 100, acquired from the ECU 32 and a work or a drive work included in the work of the engine 100 and consumed in driving the working attachment 20. At this time, the control part 50 calculates a work to be consumed in an operation of the working attachment 20 on the basis of a kinetic energy of the working attachment 20 having a variable gravity center velocity.

It has been conventionally required to calculate a force from a cylinder internal pressure of each cylinder that has a tendency to fluctuate depending on a working state and further calculate a compaction force to the ground G in view of a posture of the working attachment 20. In this respect, the calculation procedure has likelihood of involving a noise or an error, and thus faces a difficulty in easily and accurately calculating the compaction force. By contrast, the embodiment enables grasping of a work resulting from a movement of the working attachment 20 solely with a composite gravity center. The work for the calculation, i.e., the machine body motive power P(t) being information about the machine, is accurately acquirable from the ECU 32. Focusing on the correlation between the work based on the kinetic energy of the working attachment 20 and the compaction work leads to a success in easily calculating the work or compaction work for compaction to the ground G.

The embodiment further includes the input part 6 that receives an input of the target compaction work. The control part 50 calculates the target gravity center velocity on the basis of a difference between the compaction work to be exerted to the ground G by the working attachment 20 and the target compaction work input into the input part 6 by the operator.

This configuration achieves stable flat ground preparation satisfying the target compaction work desired by the operator.

The control part 50 may determine the target compaction work in accordance with a degree or value of at least one working condition, and calculate the target gravity center velocity on the basis of a difference between the compaction work to be exerted to the ground G by the working attachment 20 and the determined target compaction work.

This configuration enables setting of a preferable target compaction work in accordance with the working condition, and thus allows the operator to easily perform the flat ground preparation without feeling a burden.

The at least one working condition may include at least one of a smoothed ground angle being an angle of the ground having been smoothed by the working attachment 20, a driving velocity of the working attachment 20, a compaction strength level selected by the operator, such as strong, intermediate, and weak, to the ground by the working attachment 20, and a soil quality of the ground. The smoothed ground angle is acquirable by the IMU 33. The operator may input information about the soil quality of the ground in advance for a worksite.

This configuration enables automatic setting of a target compaction work to meet the setting of the compaction strength level desired by the operator, e.g., strong, intermediate, and weak, in addition to the working condition. The information is preferably stored in a storage section 504 or another database. Such a condition as not being stored in the database but falling within a known condition range is adoptable in combination with a plurality of conditions in a similar working state to generate a target compaction work.

This consequently enables setting of a target compaction work in such a manner that a movement satisfies working desired by the operator.

In the embodiment, the plurality of members of the working attachment 20 include the boom 21 tiltably supported on the upper slewing body 12, the arm 22 rotatably supported at the distal end of the boom 21, and the bucket 23 or leading end member that is rotatably supported at the distal end of the arm 22 and exerts a work to the ground. The manipulation part 4 includes a boom manipulation part that receives a manipulation indicated by manipulation instruction information to raise or lower the boom 21 and an arm manipulation part that receives a manipulation indicated by the manipulation instruction information to rotate the arm 22. The drive part further includes the boom cylinder 21S that extends and contracts to raise and lower the boom 21, the boom cylinder manipulative mechanism (the proportional solenoid valve 5, the control valve 7) that receives a boom instruction signal and extends or contracts the boom cylinder 21S in response to the received boom instruction signal, an arm cylinder 22S that extends and contracts to rotate the arm 22, and an arm cylinder manipulative mechanism (the proportional solenoid valve 5, the control valve 7) that receives an arm instruction signal and extends or contracts the arm cylinder 22S in response to the received arm instruction signal. The control part 50 inputs the arm instruction signal reflecting a manipulation amount of the manipulation received by the arm manipulation part into the arm cylinder manipulative mechanism, and provides a feedback correction to a manipulation amount of a manipulation received by the boom manipulation part to make the gravity center velocity approach the target gravity center velocity and inputs the boom instruction signal reflecting the corrected manipulation amount into the boom cylinder manipulative mechanism.

This configuration enables the control part 50 to stably support the boom manipulation, and thus allows the operator to easily perform the flat ground preparation while concentrating on the arm manipulation and the bucket manipulation. This results in allowing an unskilled operator to smoothly perform flat ground preparation as well.

Heretofore, the controller 1A and the hydraulic excavator 1 including the controller according to the present invention are described, but the present invention is not limited thereto and can include modifications, for example, described below.

Figure 6:
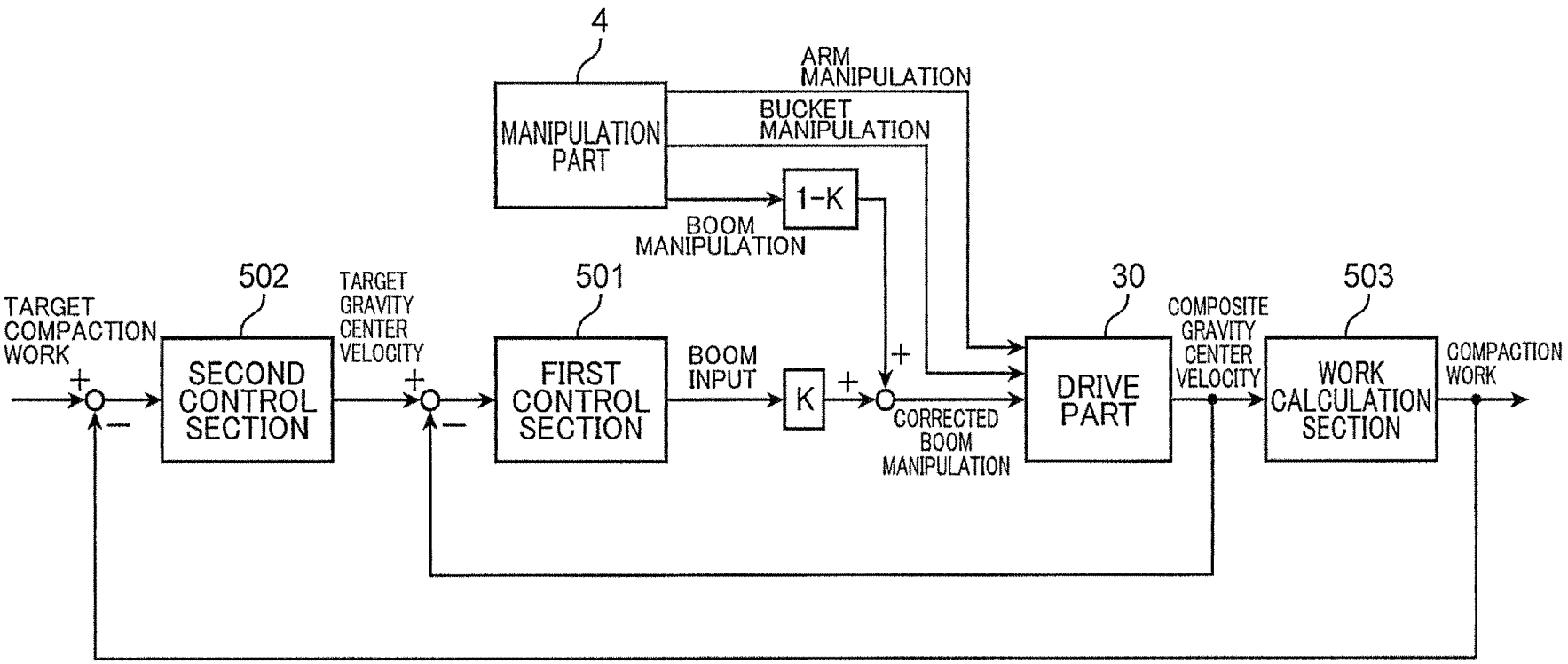
FIG. 6 is a control procedure diagram of a controller according to another embodiment of the present invention.

(1) FIG. 6 is a control procedure diagram of a controller according to another embodiment of the present invention. In this embodiment, a ratio between a boom manipulation amount by an operator and a manipulation amount set by the first control section 501 is set in advance for adjustment of a boom input u(t) by the first control section 501. In this case, a final boom input u(t) into the drive part 30 (proportional solenoid valve 5) is expressible by the following Equation 12.

Formula 12

$$u(t) = k \times u_h(i) + (1-k) \times u_c(t) \quad \text{Equation 12}$$

The sign "$u_h(t)$" denotes a boom manipulation amount by the operator, and the sign "$u_c(t)$" denotes a boom manipulation amount set by the first control section 501 of the control part 50 in the same manner as those in Equation 3. As shown in FIG. 6, a ratio between "$u_h(t)$" and "$u_c(t)$" is appropriately defined as "k" which is settable in advance, and the final boom input u(t) is expressible by Equation 12. The ratio "k" satisfies the inequality "0<k<1".

The configuration enables adjustment as to which of the manipulation amount of the manipulation by the operator and the manipulation amount by the control part 50 is given importance on the basis of a value of the ratio k. This leads to achievement of a desired assistive control in the flat ground preparation in accordance with a skill level of the operator.

(2) Although the engine 100 serves as a drive part to drive the working attachment 20, an electric motor may be adopted in place of the engine 100. The machine body motive power P(t) is not limited to an output from the engine 100, and may be a capacity or an output torque of the first pump 2A or the second pump 2B.

(3) Although the control part 50 is described to assist the boom 21 with a manipulation therefor in the embodiment, the control part 50 may control a manipulation for at least one of the boom 21, the arm 22, and the bucket 23.

(4) Although the control part 50 is described to assist an operator with flat ground preparation through an operation of the working attachment 20 in response to a manipulation to the manipulation part 4 by the operator in the embodiment, the present invention is not limited thereto. The present invention is adapted to control the hydraulic excavator 1 to automatically drive and move. In this case, the control part 50 constitutes the manipulation instruction receiving part in the present invention. Specifically, the control part 50 executes a program for the flat ground preparation to allow the working attachment 20 to conduct the flat ground preparation. The control part 50 acquires or receives, from the program, manipulation instruction information to move the working attachment 20. In this case, such a feedback correction control as described above is executed to further correct a movement of the working attachment 20 set in advance on the basis of the program to achieve stable and efficient flat ground preparation. The program may be sent and instructed from an outside of the hydraulic excavator 1 to the control part 50.

(5) The leading end member included in the working attachment 20 is not limited to the bucket 23, and may be another leading end attachment to exert a predetermined work to the ground G. Besides, a construction machine to be provided with the controller of the present invention is not limited to the hydraulic excavator, and may be another construction machine.

(6) Although the machine body includes the lower traveling body 10 in the preceding embodiment, the machine body is not limited to include such a travelable component as the lower traveling body 10 and may include a base provided in a specific portion to support the upper slewing body 12.

The present invention provides a controller for a construction machine. The construction machine includes a machine body and a working device tiltably supported on the machine body and having a plurality of members which are movable relative to each other. The controller includes a manipulation instruction receiving part, a drive part, a posture information acquisition part, and a control part. The drive part drives the working device at a velocity in accordance with an instruction signal for driving the working device. The posture information acquisition part acquires posture information about a posture of the working device relative to the machine body. The control part inputs the instruction signal into the drive part. The control part calculates a gravity center velocity being a velocity at a composite gravity center of the plurality of members on the basis of the posture information and calculates a target gravity center velocity being a target value of the gravity center velocity on the basis of a difference between a grounding work to be exerted to the ground by the working device and a target grounding work being a target value of the grounding work, and provides a feedback correction to the instruction signal to make the gravity center velocity approach the target gravity center velocity and inputs the corrected instruction signal into the drive part.

This configuration enables the control part to control a movement of the working device by inputting an instruction signal into the drive part to make the composite gravity center velocity of the working device approach the target gravity center velocity in flat ground preparation conducted by the working device. At this time, the control part calculates the target gravity center velocity on the basis of a difference between the grounding work to be exerted to the ground by the working device and the target grounding work. The configuration consequently achieves accurate flat ground preparation with a steady compaction force or pressing force of the working device to the ground at a constant composite gravity center velocity of the working device.

The configuration may further include a work information acquisition part that acquires information about an input work which is exerted by the drive part in accordance with an input energy. The control part may calculate the grounding work from a difference between the input work acquired by the work information acquisition part and a drive work being a work for driving the working device.

It has been conventionally required to calculate a compaction force to the ground in view of a posture of the working device by using a cylinder internal pressure of each cylinder that has a tendency to fluctuate depending on a working state of the construction machine. In this respect, the calculation procedure has likelihood of involving a noise or an error, and thus faces a difficulty in easily and accurately calculating the compaction force. By contrast, this configuration enables an easy and accurate calculation of the grounding work to the ground from a difference between an input work of the drive part acquired by the work information acquisition part and a drive work consumed in driving the working device.

In the configuration, the control part may calculate the drive work of the working device from a kinetic energy of the working device based on the gravity center velocity.

This configuration enables an easy calculation of the drive work of the working device by using the gravity center velocity of the working device.

The configuration may further include an input part that receives an input of the target grounding work. The control part may calculate the target gravity center velocity on the basis of a difference between the grounding work and the target grounding work input into the input part.

This configuration achieves stable flat ground preparation satisfying an input target grounding work.

In the configuration, the control part may determine the target grounding work in accordance with a degree or value of at least one working condition, and calculate the target gravity center velocity on the basis of a difference between the grounding work and the determined target grounding work. The working condition includes a condition about working to be performed by the working device.

This configuration enables setting of a preferable target grounding work in accordance with the working condition, and thus achieves facilitated and efficient flat ground preparation.

In the configuration, the at least one working condition may include at least one of a smoothed ground angle being an angle of the ground having been smoothed by the working device, a driving velocity of the working device, a strength of compaction by the working device to ground, and a soil quality of the ground.

This configuration enables automatic setting of a target grounding work to meet a value of each of the smoothed ground angle, the driving velocity of the working device, the strength of compaction, the soil quality of the ground, and other factor.

In the configuration, the plurality of members of the working device may include a boom tiltably supported on the machine body, an arm rotatably supported by the boom, and a leading end member rotatably supported by the arm for exerting a work to the ground. This configuration may further include: a boom manipulation part that receives a manipulation to raise or lower the boom; and an arm manipulation part that receives a manipulation to rotate the arm. The drive part may include a boom cylinder that extends and contracts to raise and lower the boom, a boom cylinder manipulative mechanism that extends or contracts the boom cylinder in response to a boom instruction signal, an arm cylinder that extends and contracts to rotate the arm, and an arm cylinder manipulative mechanism that extends or contracts the arm cylinder in response to an arm instruction signal. The control part may input the arm instruction signal reflecting a manipulation amount of the manipulation received by the arm manipulation part into the arm cylinder manipulative mechanism, provide the feedback correction to the boom instruction signal to make the gravity center velocity approach the target gravity center velocity, and input the corrected boom instruction signal into the boom cylinder manipulative mechanism.

This configuration enables the control part to stably support the boom manipulation, and thus allows the operator to easily perform the flat ground preparation while concentrating on the arm manipulation and the manipulation for the leading end member. This results in allowing an unskilled operator to smoothly perform flat ground preparation as well.

The present invention provides a construction machine including: a machine body; a working device tiltably supported on the machine body; and the controller described in any one of the configurations described above for the construction machine.

This configuration leads to achievement in providing a construction machine that enables flat ground preparation while keeping a steady pressing force to the ground.

The present invention provides a controller for a construction machine that enables flat ground preparation while keeping a steady pressing force to the ground and provides a construction machine including the controller.

The invention claimed is:

1. A controller for a construction machine including a machine body and a working device tiltably supported on the machine body and having a plurality of members which are movable relative to each other, the controller comprising:

a drive part that drives the working device at a velocity in accordance with an instruction signal for driving the working device;

a posture information acquisition part that acquires posture information about a posture of the working device to the machine body; and a control part that calculates a gravity center velocity being a velocity at a composite gravity center of the plurality of members on the basis of the posture information and calculates a target gravity center velocity being a target value of the gravity center velocity on the basis of a difference between a grounding work to be exerted to the ground by the working device and a target grounding work being a target value of the grounding work, and provides a feedback correction to the instruction signal to make the gravity center velocity approach the target gravity center velocity and inputs the corrected instruction signal into the drive part.

2. The controller for a construction machine according to claim 1, further comprising a work information acquisition part that acquires information about an input work which is exerted by the drive part in accordance with an input energy, wherein the control part calculates the grounding work from a difference between the input work acquired by the work information acquisition part and a drive work being a work for driving the working device.

3. The controller for a construction machine according to claim 2, wherein the control part calculates the drive work of the working device from a kinetic energy of the working device based on the gravity center velocity.

4. The controller for a construction machine according to claim 1, further comprising an input part that receives an input of the target grounding work, wherein the control part calculates the target gravity center velocity on the basis of a difference between the grounding work and the target grounding work input into the input part.

5. The controller for a construction machine according to claim 1, wherein the control part determines the target grounding work in accordance with at least one working condition, and calculates the target gravity center velocity on the basis of a difference between the grounding work and the determined target grounding work.

6. The controller for a construction machine according to claim 5, wherein the at least one working condition includes at least one of a smoothed ground angle being an angle of the ground having been smoothed by the working device, a driving velocity of the working device, a strength of compaction by the working device to ground, and a soil quality of the ground.

7. The controller for a construction machine according to claim 1, wherein the plurality of members of the working device include a boom tiltably supported on the machine body, an arm rotatably supported by the boom, and a leading end member rotatably supported by the arm for exerting a work to the ground, the controller further comprising:

a boom manipulation part that receives a manipulation to raise or lower the boom; and an arm manipulation part that receives a manipulation to rotate the arm, wherein the drive part includes a boom cylinder that extends and contracts to raise and lower the boom, a boom cylinder manipulative mechanism that extends or contracts the boom cylinder in response to a boom instruction signal, an arm cylinder that extends and contracts to rotate the arm, and an arm cylinder manipulative mechanism that extends or contracts the arm cylinder in response to an arm instruction signal, and the control part inputs the arm instruction signal reflecting a manipulation amount of the manipulation received by the arm manipulation part into the arm cylinder manipulative mechanism, provides the feedback correction to the boom instruction signal to make the gravity center velocity approach the target gravity center velocity, and inputs the corrected boom instruction signal into the boom cylinder manipulative mechanism.

8. A construction machine, comprising:

a machine body;

a working device tiltably supported on the machine body; and the controller according to claim 1.

* * * * *